US009181799B1

(12) United States Patent
Harte

(10) Patent No.: US 9,181,799 B1
(45) Date of Patent: Nov. 10, 2015

(54) FLUID SAMPLING SYSTEM

(71) Applicant: Philip T. Harte, Concord, NH (US)

(72) Inventor: Philip T. Harte, Concord, NH (US)

(73) Assignee: The United States of America, as represented by the Secretary of the Department of the Interior, Washington, DC (US)

( * ) Notice: Subject to any disclaimer, the term of this patent is extended or adjusted under 35 U.S.C. 154(b) by 460 days.

(21) Appl. No.: 13/789,401

(22) Filed: Mar. 7, 2013

Related U.S. Application Data

(60) Provisional application No. 61/662,712, filed on Jun. 21, 2012.

(51) Int. Cl.
*E21B 49/08* (2006.01)

(52) U.S. Cl.
CPC ..... *E21B 49/084* (2013.01)

(58) Field of Classification Search
CPC ..... E21B 43/12; E21B 43/14; E21B 49/08
See application file for complete search history.

(56) References Cited

U.S. PATENT DOCUMENTS

| | | | | |
|---|---|---|---|---|
| 5,335,732 | A * | 8/1994 | McIntyre | 166/313 |
| 5,404,752 | A | 4/1995 | Chace et al. | |
| 5,881,814 | A | 3/1999 | Mills | |
| 5,955,666 | A * | 9/1999 | Mullins | 73/152.18 |
| 6,250,390 | B1 | 6/2001 | Narvaez et al. | |
| 6,281,489 | B1 * | 8/2001 | Tubel et al. | 250/227.14 |
| 6,355,928 | B1 * | 3/2002 | Skinner et al. | 250/269.1 |
| 6,581,455 | B1 * | 6/2003 | Berger et al. | 73/152.55 |
| 2001/0050170 | A1 * | 12/2001 | Woie et al. | 166/252.1 |
| 2002/0109080 | A1 * | 8/2002 | Tubel et al. | 250/227.14 |
| 2004/0020652 | A1 * | 2/2004 | Campbell et al. | 166/313 |
| 2005/0140368 | A1 * | 6/2005 | Freedman | 324/303 |
| 2006/0124310 | A1 * | 6/2006 | Lopez de Cardenas et al. | 166/313 |
| 2006/0196668 | A1 * | 9/2006 | Burge et al. | 166/313 |
| 2007/0084605 | A1 * | 4/2007 | Walker et al. | 166/313 |
| 2008/0066535 | A1 * | 3/2008 | Vasques et al. | 73/152.17 |
| 2008/0164027 | A1 * | 7/2008 | Sanchez | 166/278 |
| 2008/0302529 | A1 * | 12/2008 | Fowler et al. | 166/250.01 |
| 2009/0008079 | A1 * | 1/2009 | Zazovsky et al. | 166/60 |
| 2009/0066535 | A1 * | 3/2009 | Patel et al. | 340/853.2 |
| 2009/0152456 | A1 * | 6/2009 | Waid et al. | 250/269.3 |

(Continued)

OTHER PUBLICATIONS

Barber, C. and Davis, G.B. 1987. Representative sampling of ground water from short-screened boreholes. Ground Water, V25, No. 5, 581-587 p.

(Continued)

*Primary Examiner* — Benjamin Fiorello
(74) *Attorney, Agent, or Firm* — C. Joan Gilsdorf

(57) ABSTRACT

A sampling system and a method for sampling fluid from a target zone within a well bore without commingling fluid from other zones in the well. The sampling system includes a hydraulic flow control system and a differential flow logging system. The hydraulic flow control system has a plurality of multi-level, vertically disposed pumps with fluid extraction rates set to generate hydraulic zones above and below a center one of the pumps. The hydraulic zones isolate fluid flow in a target zone surrounding the center pump, and the center pump collects a sample from the isolated target zone without mixing fluid from other zones of the well. The differential logging system has a plurality of flow devices. Each of the plurality of flow devices is disposed near one of the hydraulic zones to monitor vertical flow in the well and confirm isolation of the target zone.

15 Claims, 5 Drawing Sheets

(56) References Cited

U.S. PATENT DOCUMENTS

| | | | | |
|---|---|---|---|---|
| 2009/0288824 | A1* | 11/2009 | Fowler et al. | 166/250.17 |
| 2010/0276160 | A1* | 11/2010 | Tolman et al. | 166/386 |
| 2011/0108720 | A1* | 5/2011 | Ford et al. | 250/262 |
| 2012/0285680 | A1* | 11/2012 | Kumar | 166/264 |
| 2013/0019671 | A1* | 1/2013 | Stibbe et al. | 73/152.24 |

OTHER PUBLICATIONS

Day-Lewis, F.D., Johnson, C. D., Paillet, F.L., and Halford, K.J. 2011. A computer program for flow-log analysis of single holes (FLASH). Ground Water, doi: 10.1111/j.1745-6584.2011.00798.

U.S. Geological Survey, 2011. FLASH: a computer program for flow-log analysis of single holes. View online at http://water.usgs.gov/ogw/flash/; accessed Mar. 6, 2013.

Pitrak, M, Mares, S., and Kobr, M. 2007. A Simple Borehole Dilution Technique in Measuring Horizontal Ground Water Flow. Ground Water, V45, No. 1, 89-92 p.

Shapiro, A.M. 2002. Cautions and suggestions for geochemical sampling in fractured rock. Groundwater Monitoring and Remediation, V.22(3), p. 151-164.

Theis, C.V., 1935. The relation between the lowering of the piezometric surface and the rate and duration of discharge of a well using groundwater storage. Trans. Amer. Geophys. Union, V16, p. 519-524.

Ferris, J.G., D.B. Knowles, R.H. Brown and R.W. Stallman, 1962. Theory of aquifer tests, U.S. Geological Survey Water-Supply Paper 1536 E, 174p. (pp. 144-166).

* cited by examiner

FLUID SAMPLING SYSTEM

CROSS-REFERENCE TO RELATED APPLICATION(S)

This application is related to and claims the benefit of priority to Provisional Application U.S. Ser. No. 61/662,712, titled "Discrete Groundwater Sampling System for Open Borehole Bedrock Wells in Fractured Rock," by Philip T. Harte, filed Jun. 21, 2012 in the U.S. Patent and Trademark Office, the contents of which are incorporated herein by reference.

STATEMENT OF GOVERNMENT INTEREST

The invention described herein may be manufactured, used, and licensed by or for the U.S. Government for governmental purposes without payment of any royalties thereon.

BACKGROUND

The present invention relates in general to fluid sampling of zones in wells intersected by fractures and in long-screen wells in unconsolidated aquifers.

The GroundWater Protection Council (1999) indicates that thousands of waste disposal sites are present in the northeastern United States where fractured-rock aquifers predominate. Innovative sampling systems that can effectively and efficiently sample fluids in heterogeneous aquifers are particularly relevant in helping to identify contaminant distribution and pathways.

Fluid sampling in open boreholes tapping fractured-rock aquifers is particularly challenging because of vertical mixing of fluid within the borehole from flow from multiple fractures. The use of downhole pumps to pump water or other fluid from long, open-hole bedrock wells or long-screen sections of wells is problematic because the well bore acts as a conduit and induces vertical flow and mixing of fluid from multiple fractures at different zones (depths) throughout the entire well opening based on the transmissivity of each fracture (Shapiro, 2002). The source of the pumped fluid in an open borehole is a mixture of the well bore fluid and the flow-weighted contribution of fluid from multiple fractures. The unknown source origin of the resultant fluid sample is less than ideal for the identification of natural and anthropogenic contaminant pathways.

Packers that straddle the pumps have been used to isolate flow from discrete fractures or fracture sets to reduce capture of well bore fluid (Shapiro, 2002). However, the use of packers can be time consuming and logistically difficult. An easier and more efficient sampling system is needed.

SUMMARY

A sampling system with a multilevel pumping system is described herein that uses hydraulic containment to collect specific discrete zone fluid samples in wells having long open-hole (non-cased) bedrock wells or long-screen sections of wells without mixing and drawing of fluid from different zones (depths). The sampling system couples hydraulic control of flow in open-hole or long-screen wells with differential logging of vertical flow to surgically remove well fluid samples and quantitatively assess zonal transmissivity. The hydraulic control of flow uses pumps to isolate samples from discrete fractures within specific zones without mixing the fluid samples with fluid throughout the well. The absence of mixing is confirmed through differential flowmeter logging or dual tracer tracking. The sampling system aids scientists and water managers tasked with the challenge of identifying contaminant pathways and sources in complex fractured-rock aquifers or heterogeneous unconsolidated aquifers.

In accordance with an embodiment of the invention, a sampling system for use in a well has a sample pump disposed in a target zone of the well to collect a fluid sample from the target zone. An upper pump is disposed above the sample pump and a lower pump is disposed below the sample pump. A first flow device is disposed between the upper pump and the sample pump, and a second flow device is disposed between the sample pump and the lower pump. The upper pump, the lower pump, and the sample pump have extraction flow rates set to generate a first hydraulic zone between the first flow device and the sample pump, and a second hydraulic zone between the sample pump and the second flow device. The first and second hydraulic zones isolate the fluid in the target zone from fluid in other zones of the well, and the first flow device and the second flow device monitor fluid flow within the well to confirm isolation of the target zone.

In accordance with another embodiment of the invention, a sampling system for use in a well has a hydraulic flow control system and a differential logging system. The hydraulic flow control system has a plurality of multi-level, vertically disposed pumps with fluid extraction rates set to generate hydraulic zones above and below one of the pumps used as a sample pump. The hydraulic zones isolate fluid flow in a target zone surrounding the sample pump, and the sample pump collects a sample from the isolated target zone without mixing fluid from other zones of the well. The differential logging system has a plurality of flow devices. Each of the plurality of flow devices is disposed near the respective hydraulic zones to monitor vertical flow in the well and confirm isolation of the target zone.

In accordance with another embodiment of the invention, a method is provided for sampling fluid from a target zone within a well bore without commingling fluid from other zones in the well. In the method, locations and flow rates of fractures in a geologic formation surrounding the well and the total extraction flow rate of the well are determined by performing conventional flowmeter logging. A fracture to sample is selected and a fracture target zone is determined based upon the log results. A hydraulic flow containment system having a plurality of pumps is provided that isolates fracture fluid in the target zone from the well bore fluid. A differential flow logging system having a plurality of flow devices is disposed above and below the target zone to confirm isolation of the target zone. A fluid sample is collected from the isolated target zone using one of the pumps located in the target zone.

BRIEF DESCRIPTION OF THE DRAWINGS

Various aspects and advantages of the invention will become apparent from the following detailed description, taken in conjunction with the accompanying drawings. The drawings are not necessarily drawn to scale. In the drawings.

DETAILED DESCRIPTION OF THE PREFERRED EMBODIMENTS

A sampling system is described for the collection of specific (discrete) zone (depth-dependent) fluid samples in long open-hole (non-cased) bedrock wells or long-screen sections of wells, without mixing and drawing of fluid from different zones (depths). The sampling system couples differential logging of vertical flow with hydraulic control of flow to surgically remove the well fluid samples.

Figure 1:
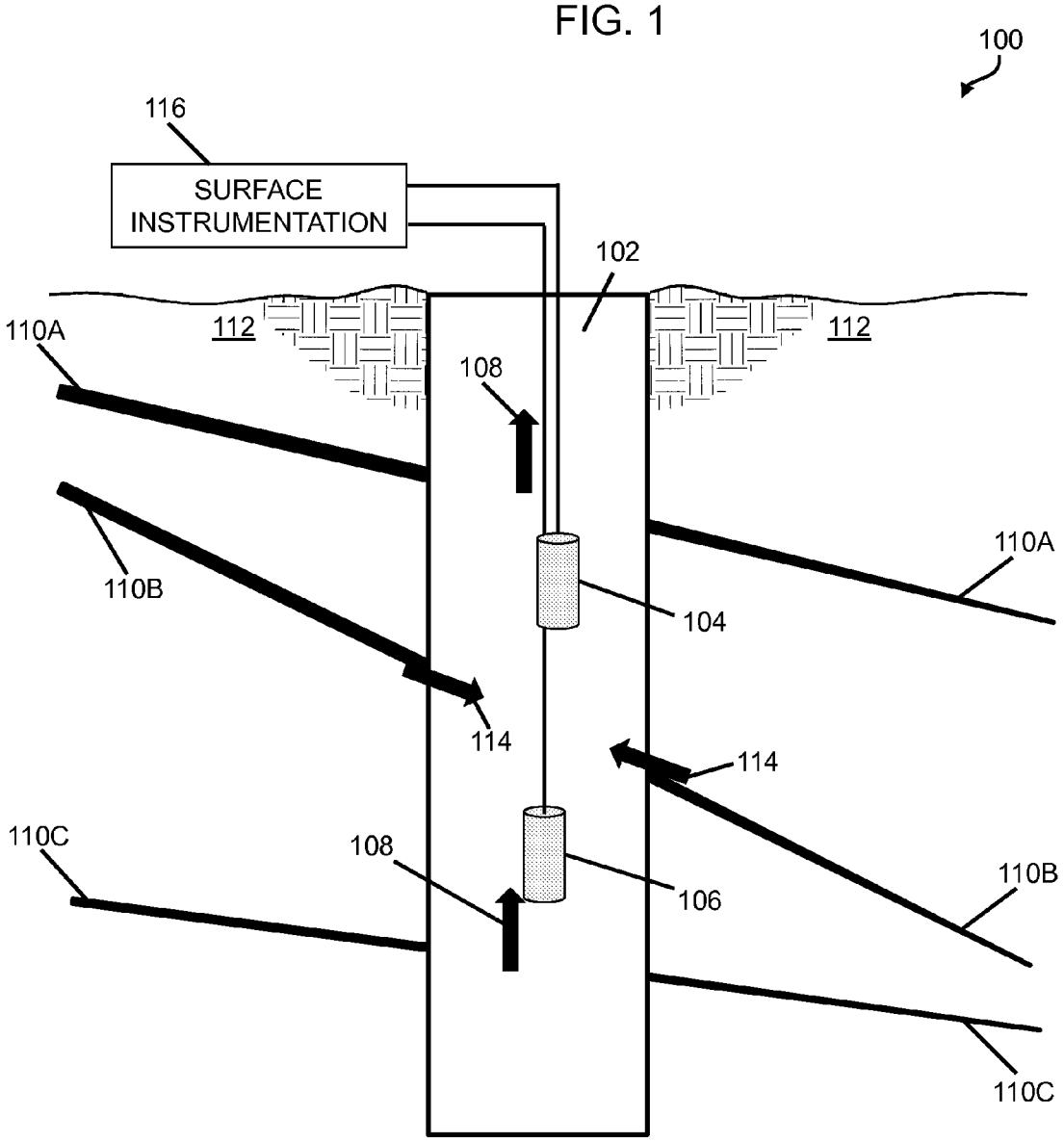
FIG. 1 is a schematic cross-sectional view of a differential flow logging system within an open hole bedrock well intersected by fractures, according to an embodiment of the invention.

A differential coupled flow logging system 100 (hereinafter "flow logging system") is illustrated in FIG. 1. The flow logging system 100 allows for synchronous recording of vertical-flow differences in an open borehole 102. In the exemplary embodiment shown in FIG. 1, the flow logging system 100 uses synchronous measurements of vertical flow from two vertically positioned flow devices 104 and 106 in the well bore 102 to facilitate estimation of vertical flow, indicated by arrows 108, from discrete fractures 110A to 110C in bedrock 112 within an aquifer. Fracture flow, such as fracture flow 114 from the fracture 110B, enters the borehole 102 and mixes with fluid from the well bore 102.

The flow devices 104 and 106 are attached to surface instrumentation 116 that interprets vertical velocity up and down the borehole 102. The flow devices 104 and 106 can be, for example, flowmeters that synchronously measure vertical flow, or dual tracer devices that track direction of flow. Synchronous measurement of vertical flow using flowmeters reduces the error associated with the repositioning of a single flowmeter during logging caused by transient hydraulics and small fluctuations in ambient and pumped flow. Differential flowmeter logging can be accomplished using, for example, heat pulse flowmeters (Hess, 1982, incorporated herein by reference), and borehole dilution logging (Pitrak et al., 2007, incorporated herein by reference). Estimates of discrete fracture flow can be facilitated using the analytical solution FLASH, developed by the U.S. Geological Survey (Day-Lewis et al., 2011, incorporated herein by reference). Alternatively, flow logging can be done using emplaced tracer devices rather than flowmeters to determine vertical flow directions.

Figure 2A:
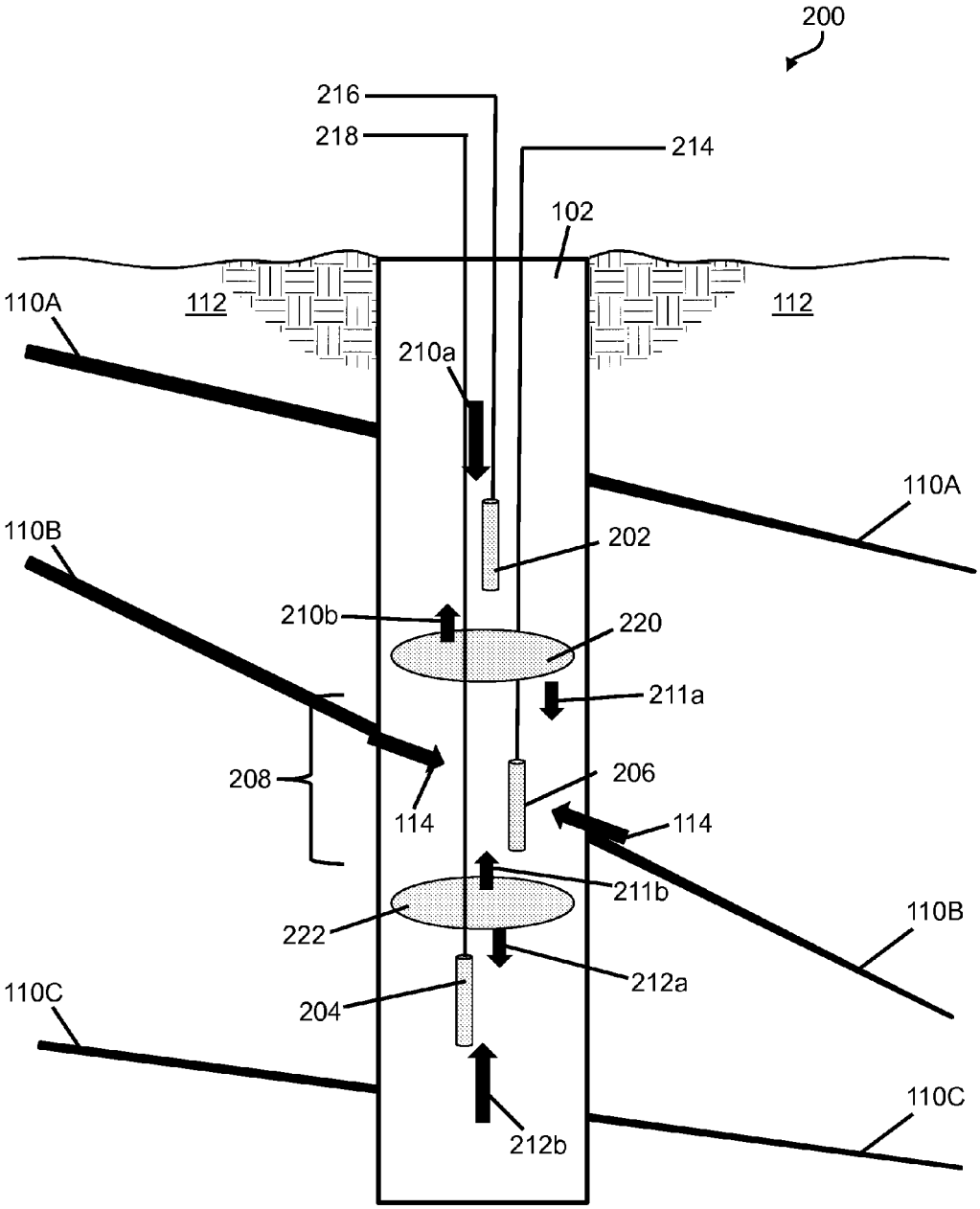
FIG. 2A is a schematic cross-sectional view of a multilevel pumping system within the well of FIG. 1 that operates to create stagnation hydraulic zones within the well, according to an embodiment of the invention.

FIG. 2A illustrates hydraulic control of flow (i.e., hydraulic containment), which is achieved by a multilevel pumping system 200 that allows for vertically positioned extraction from multiple locations in the borehole 102 by isolating discrete fracture zones for sampling. In the embodiment shown in FIG. 2A, three pumps 202, 204, and 206 are used to isolate a discrete target sample zone 208 adjacent to a selected fracture. For purposes of illustration, the fracture 110B has been selected. The middle pump 206 is a sample pump. The upper and lower pumps 202 and 204 are "waste" pumps in that they are used to extract well fluid only for hydraulic purposes rather than for sampling. The three pumps 202, 204, and 206 are vertically positioned in the well bore 102 and are variable-rate controlled pumps. The pumps 202, 204, and 206 allow for the surgical extraction of fracture fluid by isolating the fracture fluid from the well bore fluid. The target sample zone 208 is isolated based on volumetric mass balance between the fracture flow 114, the rates of extraction of the sample pump 206 and the waste pumps 202 and 204, and the borehole 102. A multiple port, multiple line deployment/extraction system (not shown) is used to deploy and extract the pumps, and to vary the vertical position of the three extraction pumps 202, 204, 206 based on the desired size of the target sample zone 208. The sample and waste fluid are pumped to the surface independently of each other. The sample is pumped through a sample line 214, and the waste fluid is pumped from the waste pumps 202 and 204 through waste lines 216 and 218, respectively.

In FIG. 2A, rates of extraction from the pumps 202, 204, and 206 are adjusted to create stagnation or minimal velocity flow zones (i.e., hydraulic zones) between adjacent vertically positioned pumps. These hydraulic zones contain the vertical extent of the fluid source of the target sample zone 208. In the embodiment shown in FIG. 2A, the waste pump 202 extracts well fluid 210*a* and 210*b*, the sample pump 206 extracts well fluid 211*a* and 211*b*, as well as fluid 114 from the target fracture 110B, and the waste pump 204 extracts well fluid 212*a* and 212*b*. The rates of extraction of the pumps 202, 204, and 206 are adjusted to create stagnation zones 220 and 222 between the sample pump 206 and the waste pumps 202 and 204, respectively. The principles of hydraulic boundaries and zones including no-flow zones are described in image well theory (Ferris et al., 1962, incorporated herein by reference).

Figure 2B:
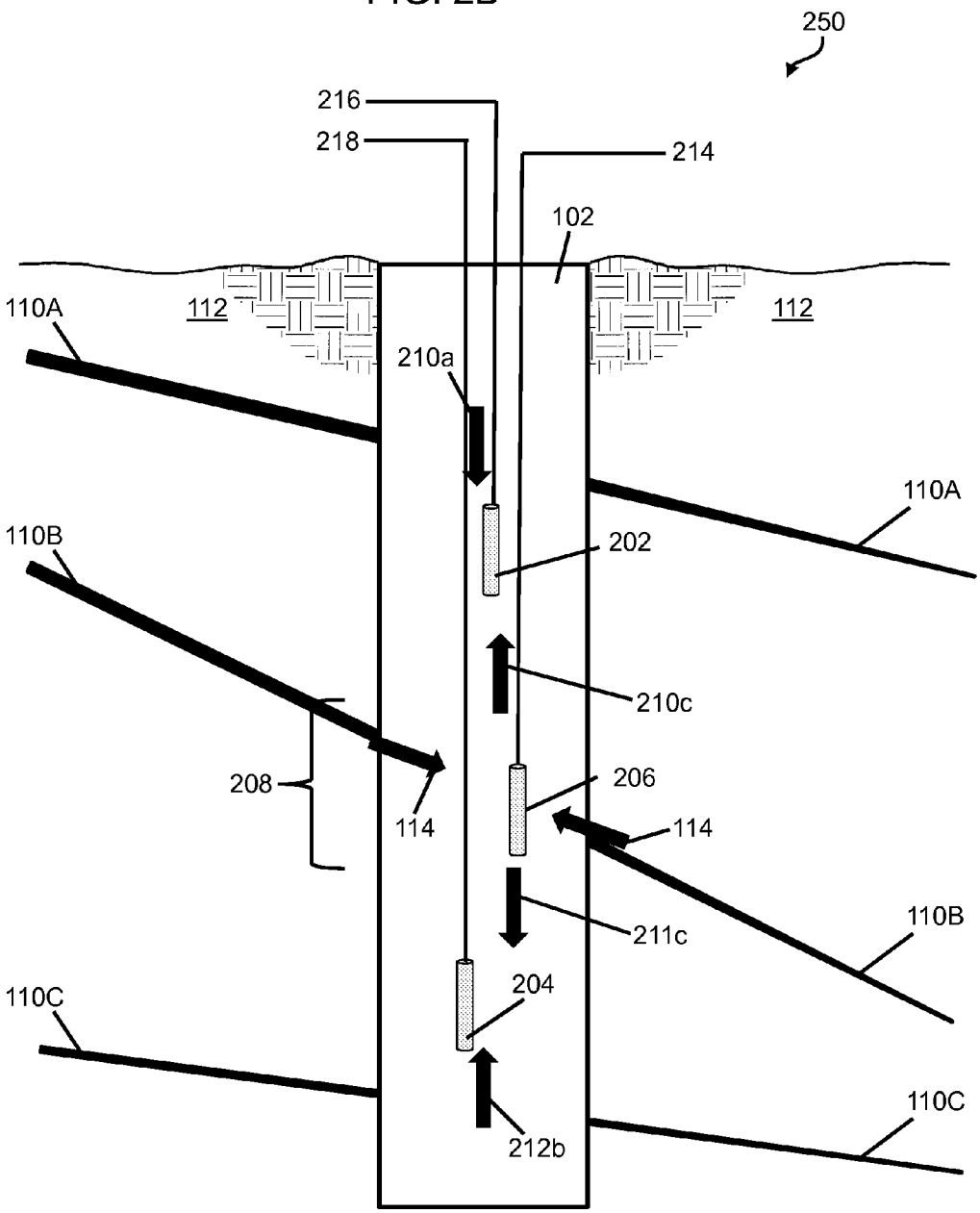
FIG. 2B is a schematic cross-sectional view of a multilevel pumping system within the well of FIG. 1 that operates to create divergent hydraulic zones within the well, according to an embodiment of the invention.

Alternatively, isolation of the target zone is also achievable by inducing divergent flow away from the target zone 208 using a sampling system 250, as shown in FIG. 2B, which prevents mixing of borehole fluid with fluid in the target zone 208. In the embodiment of FIG. 2B, the upper and lower waste pumps 202 and 204 are set at flowrates greater than the rate of the sample pump 206 causing a predominance of vertical flow 210*c* and 211*c* to move away from the target zone 208, excluding the fluid captured by the sample pump 206.

The duration of extraction of the waste pumps 202 and 204 and the sample pump 206 is dependent on the total pump rate from the three pumps, the flow rate 114 from the fracture 110B, the summation of flow rates from all other fractures excluding the target fracture 110B in the borehole 102, and the amount of fluid in the target zone 208. A minimum of about 2.3 times the volume of fluid in the target zone 208 is evacuated prior to sampling. These same principles with regard to flow in the target zone 208 and flow outside of the target zone 208 can be used to deploy the pumping systems 200 and 250 in long-screen wells set in unconsolidated aquifers.

Figure 3A:
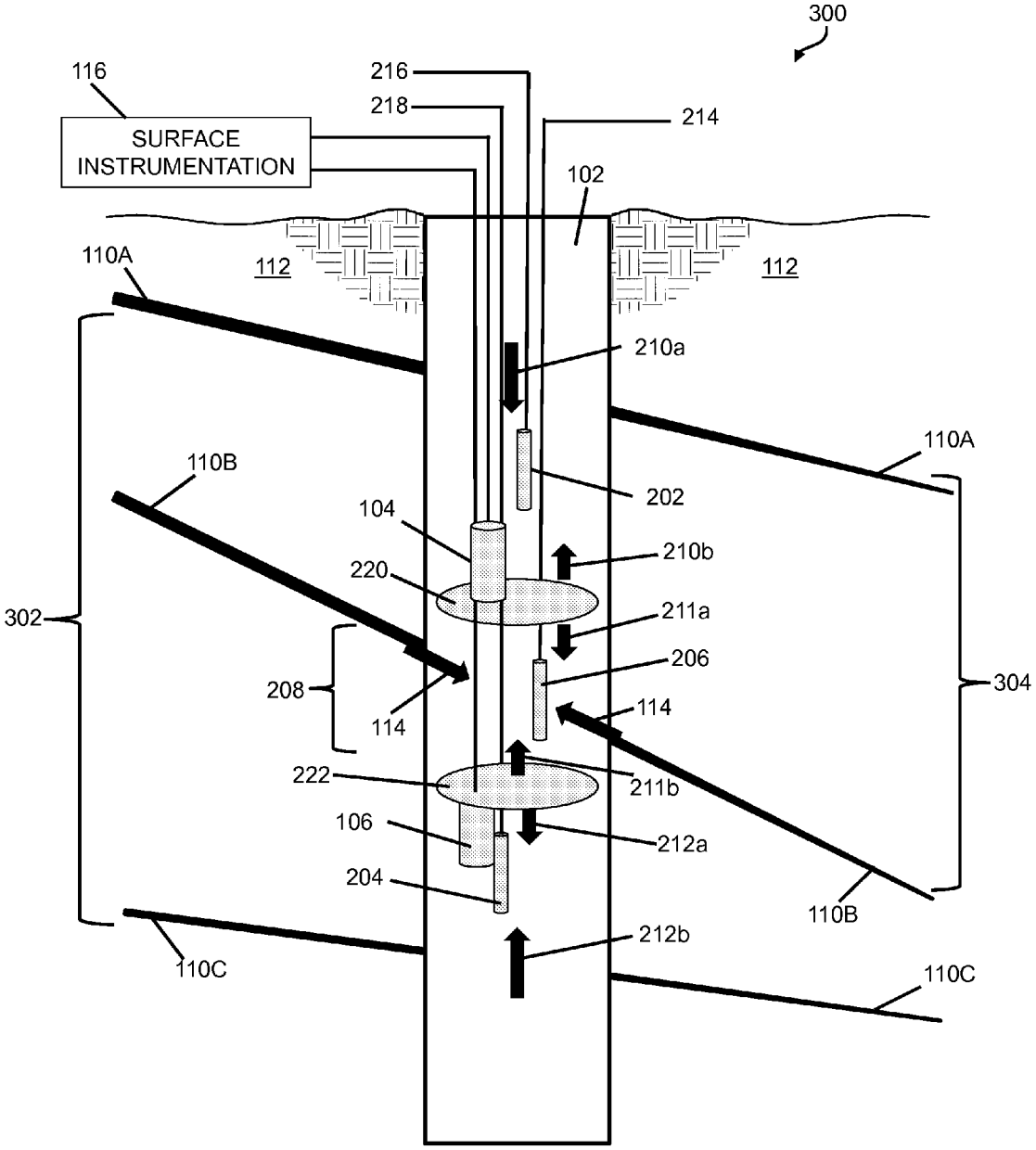
FIG. 3A is a schematic cross-sectional view of a sampling system combining the differential flow logging system of FIG. 1 and the multilevel pumping system of FIG. 2A.
Figure 3B:
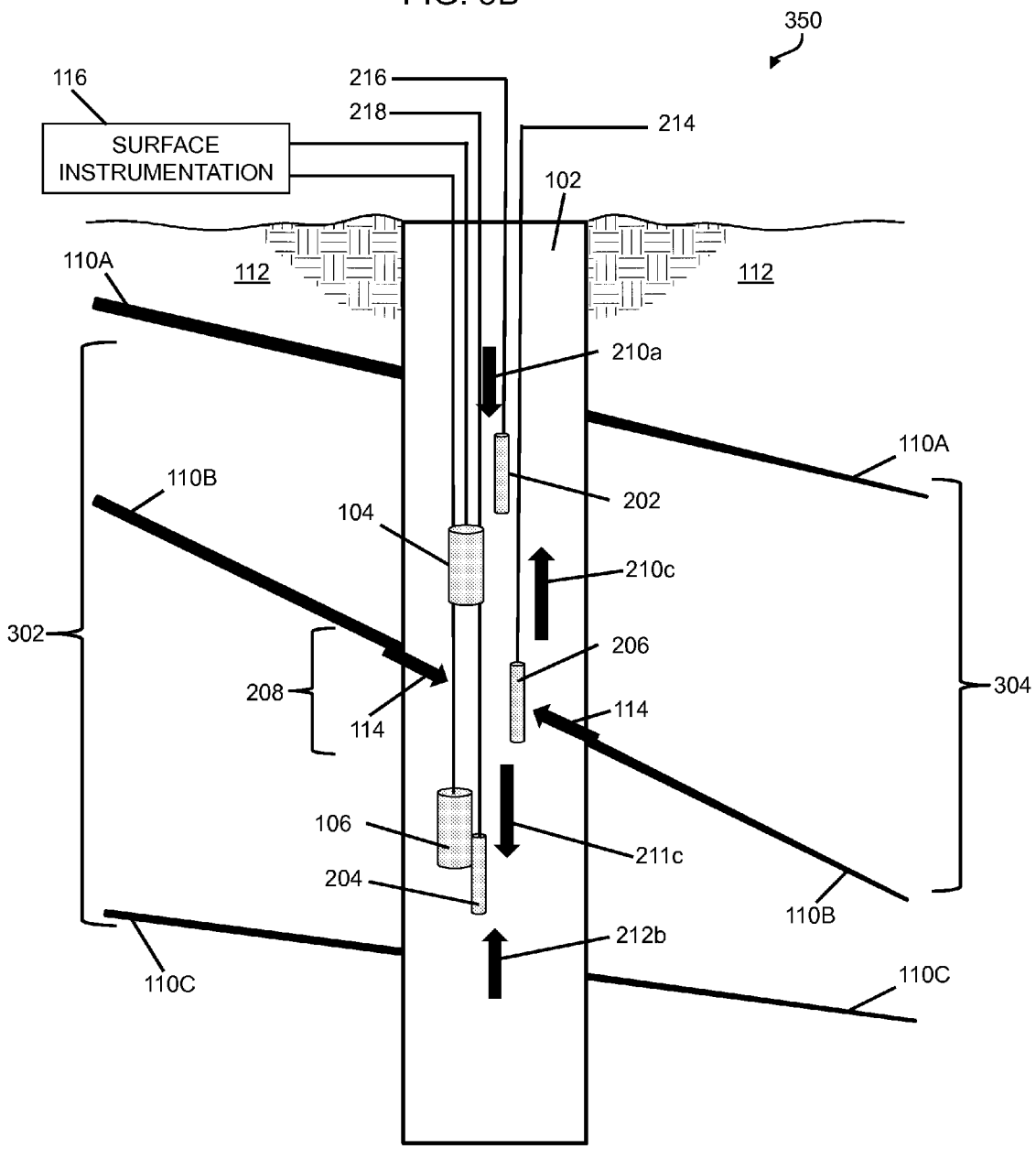
FIG. 3B is a schematic cross-sectional view of a sampling system combining the differential flow logging system of FIG. 1 and the multilevel pumping system of FIG. 2B.

The flow logging tool 100 and the multilevel pumping system 200 are combined to yield the sampling system 300 that generates the stagnation zones 220 and 222, as illustrated in FIG. 3A. Also, the flow logging tool 100 and the multilevel pumping system 250 are combined to yield the sampling system 350 that generates the diverging flows, as illustrated in FIG. 3B. The sampling systems 300 and 350 allow for hydraulic containment and isolation of flow from discrete fractures using the multilevel pumping systems 200 and 250, while isolation is confirmed with the differential flow logging system 100.

Prior to deployment of the sampling systems 300 and 350, conventional flowmeter logging (ambient and stressed) is performed to identify locations of fractures in the geologic formation 112 surrounding the well 102, and to determine their flow rates and the total extraction rate of the well 102. Additional differential logging can be done to better quantify flow from the fractures. The sampling systems 300 and 350 are configured based on the fracture flow distribution, which is used to design the proper pump rates of the waste and sample pumps 202, 204, and 206 to create either the stagnation zones 220 and 222 (FIG. 2A) or the divergent (i.e., outward) flow (FIG. 2B). The fracture to be sampled is selected. For purposes of illustration, the fracture 110B has been selected in the embodiment shown in FIGS. 3A and 3B. A preliminary extraction zone 302 is determined, which is the distance between the target fracture 110B and the next adjacent upper and lower fractures 110A and 110C. The precise target sample zone 208 is determined after the positioning of the lower and upper waste pumps 204 and 202 and the formation of the stagnation zones 220 and 222 between the waste pumps 202 and 204 and the sample pump 206 of FIG. 3A, or the formation of the divergent flow conditions as shown in FIG. 3B. The target sample zone 208 is defined as the borehole capture zone of the sample pump 206. Under divergent conditions, the target zone 208 is restricted to the location of the sample pump 206.

The pumps and flow devices are then positioned in the well 102. The lower waste pump 204 is positioned in the well 102 below the target fracture 110B and between the target fracture 110B and the next adjacent lower fracture 110C. The exact placement distance of the lower waste pump 204 below the target fracture 110B is determined based on well hydraulics including fracture inflow rates and rates of extraction of the waste and sample pumps 202, 204, and 206. The lower flow device 106 is positioned between the lower waste pump 204 and the target fracture 110B.

The sample pump 206 is positioned adjacent to the target fracture 110B. The upper flow device 104 is positioned between the sample pump 206 and the planned position of the upper waste pump 202. The upper waste pump 202 is positioned above the sample pump 206 and the upper flow device 104 between the sample fracture 110B and the next adjacent upper fracture 110A. The exact placement distance of the upper waste pump 202 above the sample pump 206 is determined based on well hydraulics including fracture inflow rates and rates of extraction of the waste and sample pumps 202, 204, and 206. For long-screen wells, the sample pump 206 is positioned at a desired depth within a selected screen interval (target zone), and the waste pumps are set based on the volumetric flow of the well screen, anticipated extraction rate of the waste pumps 202 and 204, and the length of the well screen.

The upper waste pump 202 is set a minimum distance of about 3 feet above the sample pump 206 to a maximum distance of about 1 foot below the upper fracture 110A. The lower waste pump 204 is set a minimum distance of about 3 feet below the sample pump 206 to a maximum distance of about 1 foot above the lower fracture 110C. The Theis equation (Theis, 1935, incorporated herein by reference) can be modified to further constrain the locations of the waste pumps 202 and 204 within the minimum and maximum specified distances by calculating a distance 304 between the waste pumps based upon the expected volume pumped in a desired sample time subtracted by the estimated Darcian radial flow over the target zone 208 during that same sample time, divided by 4.6 times the volume of fluid along the distance 304 in the borehole 102.

The extraction flow rate of the sample pump 206 is set at a rate equal to or less than the flow rate of the flow 114 from the target fracture 110B, as determined from the conventional and differential flowmeter logging. The extraction flow rates from the upper and lower waste pumps 202 and 204 are initially set at the total extraction flow rate of the well 102 minus the extraction flow rate of the sample pump 206. The rate of extraction from each waste pump 202, 204 is based on the position of the pump relative to the well opening, the flow rate of the target fracture 110B, and the summed inflow rates of the non-target fractures 110A and 110C, as determined by the conventional flowmeter logging. The flow rate of the upper waste pump 202 is the sum of the upper borehole flow, and the flow rate of the lower waste pump 204 is the sum of the lower borehole flow.

When initiating the pump sequence, the waste pumps 202 and 204 are turned on first. The extraction flow rate of the lower waste pump 204 is set initially at the summation of flow 212*b* from the lower borehole. The extraction flow rate of the upper waste pump 202 is set initially at the summation of flow 210*a* from the upper borehole. After stabilization of the extraction rates from the waste pumps 202 and 204, the sample pump 206 is turned on at the extraction rate commensurate with the flow rate from the target zone 208. The stagnation zones 220 and 222 (FIG. 3A) are created between the waste pumps 202 and 204 and the sample pump 206 by minimizing vertical flow between the middle sample pump 206 and the upper and lower waste pumps 202 and 204. After stabilization of the stagnation zones 220 and 222, isolation of the target sample zone 208 is confirmed using the differential flow logging system 100. Isolation is confirmed under stagnation conditions when there is no flow between the target sample zone 208 and the zones above and below the target sample zone 208.

Alternatively, confirmation that the borehole fluid is not mixing with the sample fluid can be aided by performing injection tracer tests to ensure that the sample fluid is clear from the injected tracer. The exact composition of the injected tracer, such as whether it contains a dye, is based on the compounds of interest, the field geochemistry, and whether a dual tracer device was used to confirm vertical flow. The injection tests are performed to insure that the target sample zone 208 is minimally disturbed either by balancing injection with additional extraction or by applying a non-fluid tracer (e.g., heat). Also, confirmation of the stagnation zones 220, 222 can be determined using a borehole dilution technique, which involves creating tracer-free zones in the target zone 208 after an initial uniform tracer (under pre-pump conditions) is introduced into the entire length of the borehole 102.

For example, the tracers can be frozen in porous bottles and deployed between the sample pump 206 and the waste pumps 202 and 204. Once in the well bore 102, the tracers thaw and slowly seep out of the bottles. The direction and rate of vertical flow are confirmed by tracking the presence of the tracers in the fluid extracted from the three pumps in the surface instrumentation 116. The presence of the tracers in the waste pumps 202 and 204 confirms flow away from the target zone 208 and thus no mixing of the borehole water at the target zone 208. The target zone 208 is recharged only by the flow from the targeted fracture 1106.

Preferably, the pump rates are adjusted to create stagnation zones 220 and 222 between the waste pumps 202 and 204 and the sample pump 206. However, divergent flow away from the sample fracture 110B (FIG. 3B) also facilitates the collection of discrete samples that do not contain mixed borehole water. Isolation of the target sample zone 208 is confirmed using the flow logging system 100. Isolation is confirmed under divergent conditions (FIG. 3B) when there is vertical flow away from the target zone 208 (i.e., there is no downward flow above the target zone 208 or upward flow below the target zone 208). If tracers are used, the absence of tracers in the sample pump 206 and the presence of tracers in the waste pumps 202 and 204 prove that the target zone 208 is isolated from borehole mixing.

Sample collection of the extracted fluid from the sample pump 206 begins after evacuating a minimum volume of fluid equivalent to about 2.3 times the volume of the borehole 102 between the waste pumps 202 and 204. Samples are collected from the target sample zone 208 using the sample pump 206 while extracting well fluid above the target zone 208 using the upper waste pump 202 and below the target zone 208 using the lower waste pump 204. The chemistry of the fluid extracted from the sample pump 206 and the waste pumps 202 and 204 is monitored to aid in identifying capture of fluid from the different zones in the well 102 and in the confirmation of tracer movement if dual tracer devices are deployed.

For purposes of hydraulic isolation and sampling from the target sample zone 208, either no flow above and below, or vertical flow outward or away (diverging flow) from, the target sample zone 208 produces a representative sample collected by the sample pump 206 from the fracture flow 114, while well fluid 210*a* above the upper stagnation zone 220 in FIG. 3A or above the target zone 208 in FIG. 3B is extracted by the upper waste pump 202 and well fluid 212*b* below the lower stagnation zone 222 in FIG. 3A or below the target zone 208 in FIG. 3B is extracted by the lower waste pump 204. Thus, the zone above the target zone 208 is a no-flow or up-flow zone, and the zone below the target zone 208 is a no-flow or down-flow zone.

While the sampling system described herein has been described with respect to sampling in discrete heterogeneous fracture networks, it has applications as a zone-specific sampling system using hydraulic containment in a variety of geologic formations. The sampling system works in wells with long open holes (non-cased) or long-screen sections, as well as in short open-hole or short-screen sections. In screened wells, the use of external filter packs outside the screen precludes the use of packers to isolate fluid because of short-circuiting whereas hydraulic containment can still be effective in isolating target zones. Also, discrete sampling with the sampling system can be used in the identification of emerging contaminants because of its ability to reduce mixing and dilution of groundwater. Further, the sampling system can be used as a screening tool to assist in the deployment of well screens in open boreholes. This helps ensure proper well screen placement based on vertical chemistry differences.

The sampling system described herein provides several advantages over conventional zone-specific sampling systems. For example, it uses hydraulic control to surgically extract water from discrete sample zones in wells, minimizing vertical mixing within the open hole bedrock well or long screened section of well to obtain non-mixed (homogenous) samples that are representative of the sample zone. Also, the sampling system is not cumbersome to use. It does not require the use of heavy-duty equipment (e.g., cable tools and rigs) to run or physical containment devices such as packers and, thus, can be deployed quickly and efficiently, allowing for quicker data collection of discrete chemistry. In addition, in boreholes that have undergone hydraulic fracturing, such as boreholes set in the Marcellus Shale Formation, the borehole surfaces are rough, which prevents the use of conventional zone specific sampling that relies on physical containment (e.g., use of packers) through sealing of the target zone. Hydraulic containment, utilized by the sampling system described herein, is unaffected by rough, irregular surface walls of the boreholes and can be used as an effective sampling system to isolate flow and collect discrete zone specific samples.

Collection of groundwater samples in open bedrock boreholes is problematic because of the nature of flow in fractures. The sampling system described herein allows samples to be collected in an efficient manner and therefore offers significant cost benefits to the groundwater and petroleum communities, as well as the ability to determine solute transport in fractured-rock aquifers and the effect of fracture connectivity on borehole flow and sampling, such as whether fracture connections outside the borehole can be identified.

Thus, it will be appreciated by those skilled in the art that modifications and variations of the present invention are possible without departing from the principles and spirit of the invention, the scope of which is defined in the appended claims and their equivalents.

GENERAL BIBLIOGRAPHY ON THE SUBJECT

The following bibliography provides citations to the references cited in the above text. The references are provided merely to clarify the description of the present invention and citation of a reference either in the bibliography below or in the specification above is not an admission that any such reference is "prior art" to the invention described herein.

Day-Lewis, F. D., Johnson, C. D., Paillet, F. L., and Halford, K. J. 2011. A computer program for flow-log analysis of single holes (FLASH). Ground Water, doi: 10.1111/j.1745-6584.2011.00798.

Ferris, J. G., D. B. Knowles, R. H. Brown and R. W. Stallman, 1962. Theory of aquifer tests, U.S. Geological Survey Water-Supply Paper 1536 E, 174p.

Hess, A. E., 1982. A heat-pulse flowmeter for measuring low velocities in boreholes: U.S. Geological Survey Open-File Report 82-699, 44 p.

Ground Water Protection Council, 1999. Ground Water Report to Congress: Summaries of State Ground Water Conditions, 109p.

Pitrak, M, Mares, S., and Kobr, M. 2007. A Simple Borehole Dilution Technique in Measuring Horizontal Ground Water Flow. Ground Water, V45, no. 1, 89-92 p.

Shapiro, A. M. 2002. Cautions and suggestions for geochemical sampling in fractured rock. Groundwater Monitoring and Remediation, V.22(3), p. 151-164.

Theis, C. V., 1935. The relation between the lowering of the piezometric surface and the rate and duration of discharge of a well using groundwater storage. Trans. Amer. Geophys. Union, V16, p. 519-524.

What is claimed is:

1. A sampling system for use in a well, comprising:

a sample pump disposed in a target zone of the well to collect a fluid sample from the target zone;

an upper pump disposed above the sample pump;

a lower pump disposed below the sample pump;

a first flow device disposed between the upper pump and the sample pump; and a second flow device disposed between the sample pump and the lower pump, wherein the upper pump, the lower pump, and the sample pump have extraction flow rates set to generate a first hydraulic zone between the first flow device and the sample pump and a second hydraulic zone between the sample pump and the second flow device, the first and second hydraulic zones isolating the fluid in the target zone from fluid in other zones of the well, and wherein the first flow device and the second flow device monitor fluid flow within the well to confirm isolation of the target zone.

2. The sampling system of claim 1, wherein the first flow device and the second flow device are flowmeters that synchronously measure vertical flow of fluid entering the well from a plurality of fractures in a geologic formation surrounding the well.

3. The sampling system of claim 2, wherein the sample pump is positioned adjacent to a target fracture within the target zone, and the target zone is isolated based on volumetric mass balance between fluid flow from the target fracture, rates of extraction of the sample pump and the upper pump and the lower pump, and a borehole of the well.

4. The sampling system of claim 1, wherein the upper pump has an extraction flow rate set at about a summation of flow in an upper portion of the well, the lower pump has an extraction flow rate set at about a summation of flow in a lower portion of the well, and the sample pump has an extraction flow rate set at about a flow rate of the target zone, and the first hydraulic zone and the second hydraulic zone are stagnation zones.

5. The sampling system of claim 1, wherein the upper pump and the lower pump have extraction flow rates greater than the extraction flow rate of the sample pump, and the first hydraulic zone and the second hydraulic zone are located at upflow and downflow zones created between the sample pump and the upper pump and between the sample pump and the lower pump, respectively.

6. A method for sampling fluid from a target zone within a well bore without commingling fluid from other zones in the well, comprising:

determining locations and flow rates of fractures in a geologic formation surrounding the well and the total extraction flow rate of the well;

selecting a fracture to sample and determining a fracture target zone based upon the log results;

providing a hydraulic flow containment system having a plurality of pumps and isolating fracture fluid in the target zone from the well bore fluid using the hydraulic flow containment system;

providing a differential flow logging system having a plurality of flow devices disposed above and below the target zone to assess zonal transmissivity, and confirming isolation of the target zone using the differential flow logging system; and collecting a fluid sample from the isolated target zone using one of the pumps located in the target zone.

7. The method of claim 6, wherein said determining a fracture target zone comprises:

setting a preliminary target zone as the distance from an adjacent fracture above the selected fracture and an adjacent fracture below the selected fracture; and adjusting the size of the target zone based on volumetric mass balance between fluid flow from the selected fracture in the target zone, fluid extraction by the sample pump and the upper pump and the lower pump, and a borehole of the well.

8. The method of claim 6, wherein said providing a hydraulic flow containment system having a plurality of pumps comprises:

providing an upper pump, a lower pump, and a sample pump;

positioning the lower pump between the selected fracture and the next adjacent fracture below the selected fracture;

positioning the sample pump in the target zone adjacent to the selected fracture;

positioning the upper pump between the selected fracture and the next adjacent fracture above the selected fracture;

setting an extraction flow rate of the sample pump to a rate equal to or less than the flow rate of the selected fracture; and setting an initial extraction flow rate of the upper and lower pumps to a rate equal to the total extraction flow rate of the well minus the extraction flow rate of the sample pump.

9. The method of claim 8, wherein said isolating fracture fluid in the target zone comprises adjusting the extraction flow rates of the upper and lower pumps to create a first hydraulic zone between the upper pump and the sample pump and a second hydraulic zone between the sample pump and the lower pump, the first and second hydraulic zones isolating the target zone.

10. The method of claim 9, wherein said adjusting the extraction flow rates of the upper and lower pumps to create the first and second hydraulic zones comprises creating flow paths away from the selected fracture in zones above and below the target zone, wherein the first hydraulic zone is an up-flow zone and the second hydraulic zone is a downflow zone.

11. The method of claim 9, wherein said adjusting the extraction flow rates of the upper and lower pumps to create the first and second hydraulic zones comprises creating stagnation or no-flow zones between the sample pump and the upper and lower pumps, respectively.

12. The method of claim 9, wherein said providing a differential flow logging system having a plurality of flow devices disposed above and below the target zone to assess zonal transmissivity comprises:

providing an upper flowmeter and a lower flowmeter;

positioning the lower flowmeter between the lower pump and the sample pump near the second hydraulic zone; and positioning the upper flowmeter between the upper pump and the sample pump near the first hydraulic zone.

13. The method of claim 9, wherein said providing a differential flow logging system having a plurality of flow devices disposed above and below the target zone to assess zonal transmissivity comprises:

providing an upper tracer device and a lower tracer device to monitor vertical flow direction;

positioning the lower tracer device between the lower pump and the sample pump near the second hydraulic zone; and positioning the upper tracer device between the upper pump and the sample pump near the first hydraulic zone.

14. The method of claim 9, wherein said collecting a fluid sample from the isolated target zone comprises:

initially evacuating a volume of water equivalent to about 2.3 times the volume of the borehole between the upper and lower pumps;

collecting samples from the target zone using the sample pump while extracting well water above the first hydraulic zone using the upper pump and below the second hydraulic zone using the lower pump; and measuring well chemistry of fluids collected from the sample pump, the upper pump, and the lower pump and tracking the well chemistry from the target zone and a borehole of the well to assess sources of fluids entering the well.

15. The method of claim 6, wherein said confirming isolation of the target zone using a flow logging system comprises assessing zonal transmissivity in the target zone and borehole to confirm no flow above and below the target zone or vertical flow away from the target zone.

* * * * *